US009324531B2

(12) United States Patent
Kibushi et al.

(10) Patent No.: US 9,324,531 B2
(45) Date of Patent: Apr. 26, 2016

(54) FUSE UNIT

(75) Inventors: Hidenori Kibushi, Makinohara (JP); Yusuke Matsumoto, Makinohara (JP); Toshiko Masuda, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 536 days.

(21) Appl. No.: 13/575,166

(22) PCT Filed: Feb. 2, 2011

(86) PCT No.: PCT/JP2011/052179

§ 371 (c)(1), (2), (4) Date: Jul. 25, 2012

(87) PCT Pub. No.: WO2011/096451

PCT Pub. Date: Aug. 11, 2011

(65) Prior Publication Data

US 2012/0293295 A1 Nov. 22, 2012

(30) Foreign Application Priority Data

Feb. 3, 2010 (JP) ..... 2010-022153

(51) Int. Cl.
*H01H 85/02* (2006.01)
*H01H 85/044* (2006.01)
(Continued)

(52) U.S. Cl.
CPC ..... *H01H 85/044* (2013.01); *H01H 85/12* (2013.01); *H01H 85/143* (2013.01); *H01H 85/2045* (2013.01); *H01H 2085/025* (2013.01); *H01H 2085/0555* (2013.01)

(58) Field of Classification Search
CPC ... H01H 85/044; H01H 85/12; H01H 85/143; H01H 2085/025; H01H 85/2045; H01H 2085/0555
USPC ..... 337/142, 186, 187, 251, 295
See application file for complete search history.

(56) References Cited

U.S. PATENT DOCUMENTS 1,404,114 A * 1/1922 Gors ..... 337/237
1,684,432 A * 9/1928 Clemens ..... 337/250
(Continued)

FOREIGN PATENT DOCUMENTS

EP 1124246 A2 8/2001
JP 10-177836 A 6/1998
(Continued)

OTHER PUBLICATIONS

International Search Report for PCT/JP2011/052179 dated Mar. 15, 2011 [PCT/ISA/210].
(Continued)

*Primary Examiner* — Anatoly Vortman
(74) *Attorney, Agent, or Firm* — Sughrue Mion, PLLC

(57) ABSTRACT

A fuse unit is provided having a fuse element (2) in which a first terminal connecting part (4) and second terminal connecting parts (5) are formed and an insulative resin part (20) is formed on the outer surface of the fuse element (2) with insertion molding. Threaded bolt holes (10) are formed in the first terminal connecting part (4) and the second terminal connecting parts (5) of the fuse element (2). Bolts (30) are temporarily fixed to the fuse element (2) by being screwed into the threaded bolt holes (10), and the insulating resin part (20) is formed with insertion molding by using the fuse element (2) to which the bolts (30) are temporarily fixed as an inserted component.

2 Claims, 13 Drawing Sheets

(51) Int. Cl.

| | |
|---|---|
| ***H01H 85/12*** | (2006.01) |
| ***H01H 85/143*** | (2006.01) |
| *H01H 85/20* | (2006.01) |
| *H01H 85/055* | (2006.01) |

(56) References Cited

U.S. PATENT DOCUMENTS

| | | | | |
|---|---|---|---|---|
| 4,531,806 | A * | 7/1985 | Hsieh | 439/620.29 |
| 5,088,940 | A | 2/1992 | Saito | |
| 5,795,193 | A | 8/1998 | Yang | |
| 5,805,047 | A * | 9/1998 | De Villeroche et al. | 337/290 |
| 6,168,470 | B1 * | 1/2001 | Ikeda et al. | 439/620.08 |
| 6,294,978 | B1 * | 9/2001 | Endo et al. | 337/166 |
| 6,448,882 | B1 * | 9/2002 | Inaba et al. | 337/227 |
| 6,509,824 | B2 * | 1/2003 | Inaba et al. | 337/295 |
| 6,806,421 | B2 * | 10/2004 | Matsumura | 174/50 |
| 6,830,482 | B2 * | 12/2004 | Matsumura et al. | 439/620.27 |
| 6,902,434 | B2 * | 6/2005 | Stack | 439/620.28 |
| 7,717,750 | B1 * | 5/2010 | Layer | 439/620.26 |
| 8,721,367 | B2 * | 5/2014 | Matsumoto et al. | 439/620.26 |
| 8,821,190 | B2 * | 9/2014 | Matsumura et al. | 439/620.27 |
| 2001/0011939 | A1 | 8/2001 | Inaba et al. | |
| 2009/0108982 | A1 * | 4/2009 | Ohashi et al. | 337/191 |

FOREIGN PATENT DOCUMENTS

| | | | |
|---|---|---|---|
| JP | 11-105590 | A | 4/1999 |
| JP | 2001-093399 | A | 4/2001 |
| JP | 2001231130 | A | 8/2001 |
| JP | 2001-297683 | A | 10/2001 |
| JP | 2009-076408 | A | 4/2009 |

OTHER PUBLICATIONS

Written Opinion for PCT/JP2011/052179 dated Mar. 15, 2011 [PCT/ISA/237].

Chinese Office Action issued May 6, 2014, in corresponding Application No. 201180008366.8.

Office Action dated Nov. 27, 2014, issued by the State Intellectual Property Office of the P.R. China in counterpart Chinese Application No. 201180008366.8.

Office Action dated Mar. 11, 2015, issued by the German Patent Office in counterpart German Application No. 11 2011 100 434.6.

* cited by examiner (a)

(b)

(a)

(b)

(a)

(b)

FUSE UNIT

This application claims the priority of Japanese Patent Application 2010-022153 filed on Feb. 3, 2010, the content of which is incorporated herein by reference.

TECHNICAL FIELD

The invention is related to a fuse unit to which a terminal is fixed with a bolt which is fixed to a terminal connecting part.

BACKGROUND ART

A first conventional example of this kind of fuse unit is disclosed in a JP-A-2009-076408. A fuse unit 50, as shown in FIG. 11, includes a fuse element 51 which is formed of a conductive metal plate, and an insulative resin part 60 which is formed with insertion molding by using the fuse element 51 as an inserted component.

The fuse element 51, as shown in FIG. 13 in detail, includes a power supply connecting part 52 which is fixed to a battery post (not shown in the figure) via a battery connecting terminal (not shown in the figure), a first terminal connecting part 53 which has a bolt 70, a plurality of tab-shaped second terminal connecting parts 54, and a plurality of fusible parts 55 which are respectively arranged between the power supply connecting part 52 and the first terminal connecting part 53 and the second terminal connecting parts 54.

A U-shaped bolt insertion hole 53*a* is formed in the first terminal connecting part 53 of the fuse element 51. As shown in FIG. 14 in detail, a press fitting space 61 is formed of the insulative resin part 20 at the back side of the bolt insertion hole 53*a*.

The bolt 70, whose rod 70*b* is inserted into the bolt insertion hole 53*a*, is fixed by press fitting the head 70*a* in the press fitting space 61 (refer to FIG. 12).

In a second conventional example, as shown in FIG. 15, pin entrances 80*a* where pressing pins (not shown) of a metal mold can enter are formed in the fuse element 80, and an insulative resin part (not shown in the figure) is formed with insertion molding by using a bolt 70A, which is positioned by the pressing pin (not shown in the figure) together with the fuse element 80 as inserted components. The inserted bolt 70A is fixed with the insulating resin which is filled around the inserted bolt 70A.

SUMMARY OF INVENTION

Technical Problem

In the above-mentioned first conventional example, since the process of press fitting the bolt 70 is required after the insulative resin part 60 is insertion molded, the manufacturing process is troublesome.

In the second conventional example, the direction of the bolt 70A which can be positioned with the pressing pins (not shown in the figure) of the metal mold is restricted. For example, as shown in FIG. 15, since bolts 70B which move in a right-left direction cannot be positioned with the metal mold if the bolt 70A which moves in an up-down direction is positioned as above, the design flexibility of the fuse element 80 is restricted. Since it is necessary to provide the pins which are pressed against the metal mold, the structure of the metal mold is complicated.

Thus, the invention is made in order to solve the above-mentioned problems, and the purpose of the invention is to provide a fuse unit so that the manufacturing process becomes simple, the design flexibility of the fuse element is not restricted due to the setting direction of bolts, and the structure of the metal mold is not complicated.

Solution to Problem

According to a first exemplary embodiment, there is provided a fuse unit comprising:

a fuse element in which a terminal connecting part is formed; and an insulative resin part which is arranged on an outer surface of the fuse element, wherein a temporary bolt fixing part which temporarily fixes a bolt to the terminal connecting part is provided in the fuse element.

According to a second exemplary embodiment, there is provided the fuse unit according to the first exemplary embodiment, wherein the temporary bolt fixing part is a threaded bolt hole which is provided in the terminal connecting part.

According to a third exemplary embodiment, there is provided the fuse unit according to the first exemplary embodiment, wherein the temporary bolt fixing part includes a bolt hole which is provided in the terminal connecting part and which has an opening at an end of the fuse element, and a bolt holding part which holds a head of the bolt which is slid and inserted into the bolt hole.

According to a fourth exemplary embodiment, there is provided the fuse unit according to the third exemplary embodiment, wherein the bolt holding part is formed by bending the fuse element.

Advantageous Effects of Invention

According to a first object of the invention, since the bolt can be temporarily fixed to the fuse element, the insulative resin part can be formed with insertion molding by using both the fuse element and the bolt as inserted components. Therefore, it is not necessary to press fit the bolt after the insertion molding. Since the bolt can be temporarily fixed with the fuse element alone, the bolt can be temporarily fixed irrespective of the direction of the bolt. Therefore, the manufacturing process becomes simple, the design flexibility of the fuse element will not be restricted due to the setting direction of the bolt, and the structure of the metal mold is not complicated.

According to a second object of the invention, in addition to the effect of the first invention, since the bolt can be temporarily fixed only by being screwed into the threaded bolt hole, it is easy to temporarily fix.

According to a third object of the invention, in addition to the effect of the first invention, since the bolt can be temporarily fixed only by being slid and inserted into the bolt hole, it is easy to temporarily fix.

According to a fourth object of the invention, in addition to the effect of the third invention, since the bolt holding part can be formed by bending the fuse element, the bolt holding part can be manufactured easily without additional manufacturing processes or components.

DESCRIPTION OF EXEMPLARY EMBODIMENTS

Below, the embodiments of the invention are described based on the figures.

First Embodiment

Figure 1:
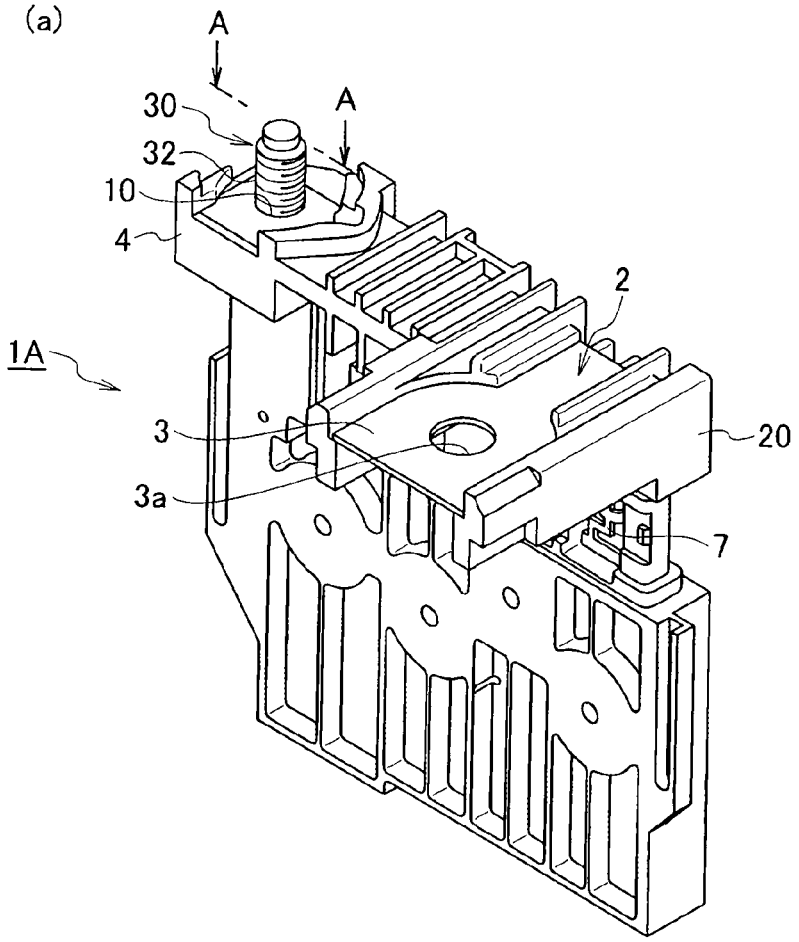
FIG. 1 shows a first embodiment of the invention, in which FIG. 1(*a*) is a perspective view of a fuse unit and FIG. 1(*b*) is an A-A line enlarged sectional view of FIG. 1(*a*).
Figure 1:
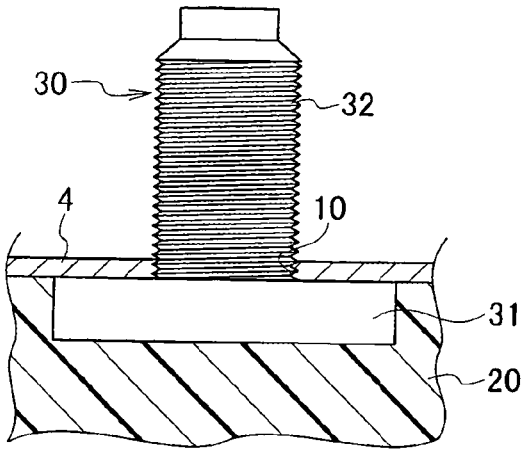
Figure 2:
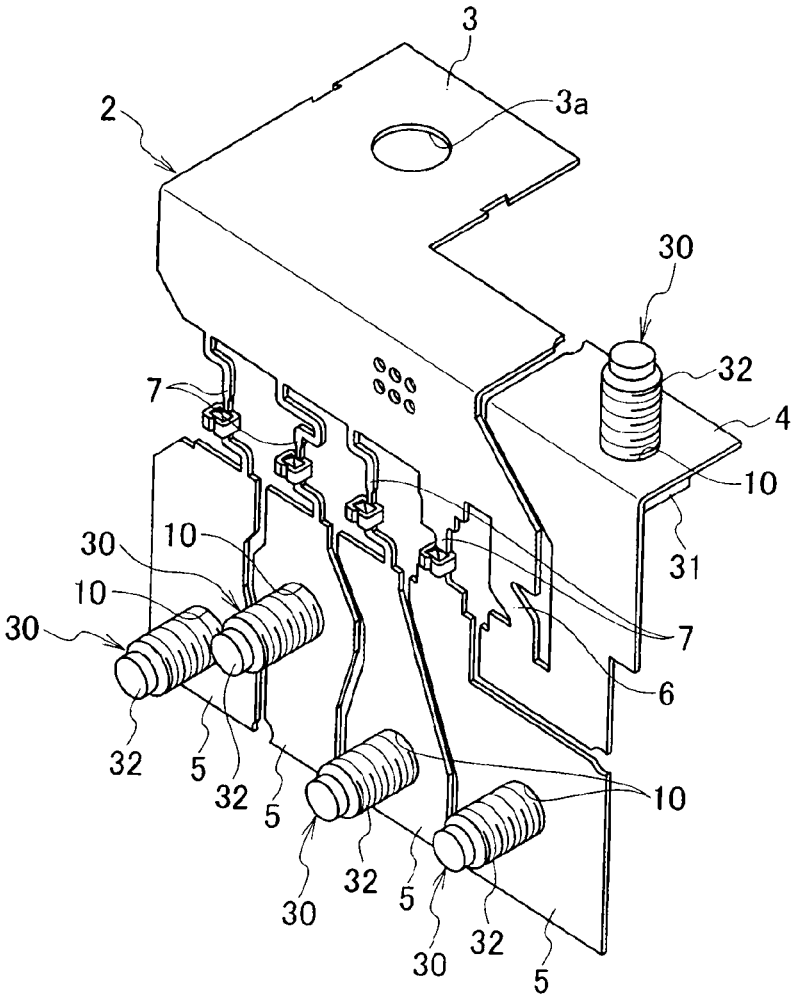
FIG. 2 shows the first embodiment of the invention and is a perspective view of a fuse element to which bolts are temporarily fixed.
Figure 3:
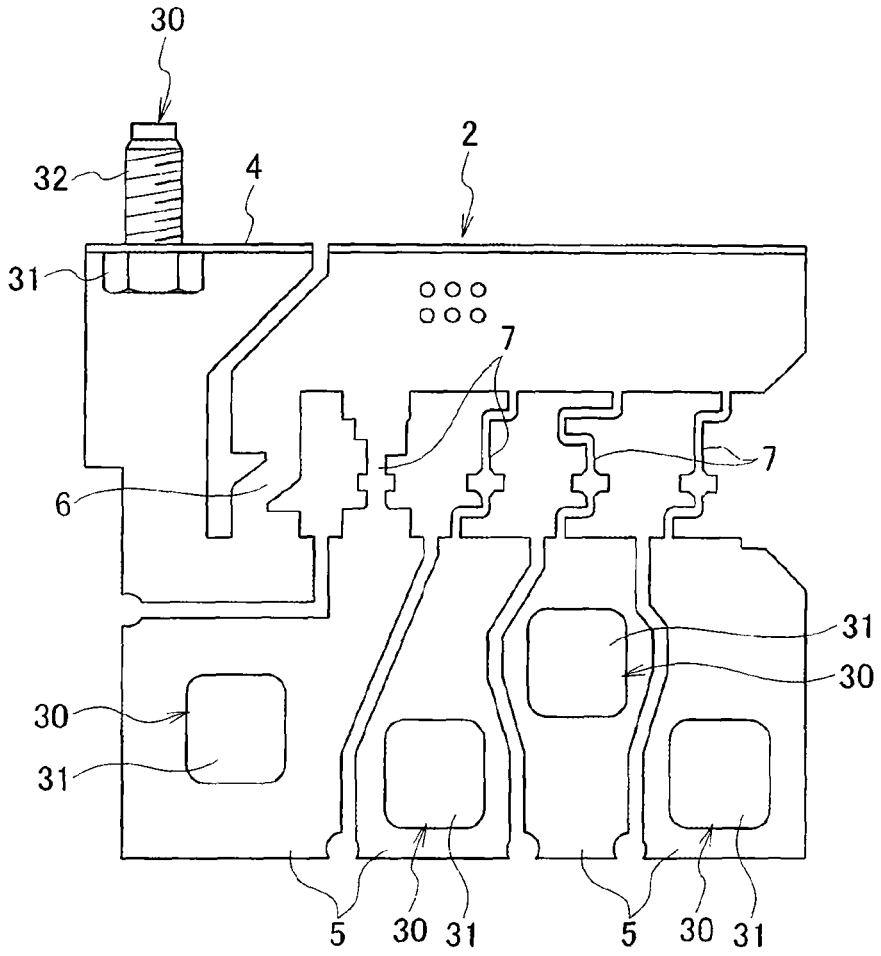
FIG. 3 shows the first embodiment of the invention and is a back view of the fuse element to which the bolts are temporarily fixed.

FIGS. 1 to 3 show the first embodiment of the invention, in which FIG. 1(*a*) is a perspective view of a fuse unit 1A, FIG. 1(*b*) is an A-A line enlarged sectional view of FIG. 1(*a*), FIG. 2 is a perspective view of a fuse element 2 to which bolts 30 are temporarily fixed, and FIG. 3 is a back view of the fuse element 2 to which the bolts 30 are temporarily fixed.

As shown in FIG. 1(*a*), the fuse unit 1A includes a fuse element 2 which is formed of a conductive metal plate (busbar), and an insulative resin part 20 which is arranged on the outer surface of the fuse element 2.

The fuse element 2, as shown in FIGS. 2 and 3 in detail, includes a power supply connecting part 3 which is fixed to a battery post (not shown in the figures) via a battery connecting terminal (not shown in the figures), a first terminal connecting part 4 and four second terminal connecting parts 5 which have bolts 30, a first fusible part 6 which is arranged between the power supply connecting part 3 and the first fusible part 6, and four second fusible parts 7 which are respectively arranged between the power supply connecting part 3 and the second terminal connecting parts 5.

A bolt insertion through hole 3*a* is formed in the power supply connecting part 3. The battery connecting terminal (not shown in the figures) is fixed by using the bolt insertion through hole 3*a*.

Threaded bolt holes 10 which are temporary bolt fixing part are formed in the first terminal connecting part 4 and the second terminal connecting parts 5, respectively. That is, a screw groove (a symbol is not given particularly) is formed on the inner surface of each of the threaded bolt holes 10. The bolts 30 are screwed into the threaded bolt holes 10, respectively. The bolt 30 includes a head 31 and a rod 32 on the outer surface of which a screw groove is formed. The bolt 30 can be temporarily fixed with the fuse element 2 alone by being screwed into the threaded bolt hole 10.

The insulative resin part 20 is formed with insertion molding by using both the fuse element 2 and the bolts 30, which are temporarily fixed to the fuse element 2, as inserted components. The insulative resin part 20 generally covers those parts other than the electric supply connecting part 3, the first terminal connecting part 4, the second terminal connecting parts 5, the first fusible part 6 and the second fusible parts 7. The insulative resin part 20 is arranged so that there is no gap around the head 31 of each of the bolts 30, as shown in FIG. 1(*b*) in detail. The head 31 of each of the bolts 30 is fixed with the insulative resin part 20 so that the head 31 cannot rotate.

Terminals (not shown in the figures) which are inserted to the bolts 30 are fixed to the first terminal connecting part and the second terminal connecting parts by being fastened with nuts (not shown in the figures).

Next, a method of manufacturing the fuse unit 1A of the above-mentioned structure is explained briefly. First, the fuse element 2 of a desired shape is manufactured by punching and bending a conductive metal plate material.

Next, the threaded bolt holes 10 are formed by cutting the screw grooves on the holes of the first terminal connecting part 4 and the second terminal connecting parts 5, respectively.

Next, the bolts 30 are screwed into the threaded bolt holes 10, respectively. Thereby, as shown in FIGS. 2 and 3, the bolts 30 are temporarily fixed to the fuse element 2.

Next, by using the fuse element 2 to which the bolts 30 are temporarily fixed as an inserted component, the insulative resin part 20 is formed with insertion molding on the outer surface of the fuse element 2. Thus, the manufacture of the fuse unit 1A shown in FIGS. 1(*a*) and 1(*b*) is completed.

As described above, since the threaded bolt holes 10 which are temporary bolt fixing part are provided in the first terminal connecting part 4 and the second terminal connecting parts 5 of the fuse element 2 so that the bolts 30 can be temporarily fixed to the fuse element 2, the insulative resin part 20 can be formed with insertion molding by using both the fuse element 2 and the bolts 30 as inserted components as explained above. Therefore, it is not necessary to press fit the bolts after the insertion molding. Since the bolts 30 can be temporarily fixed with the fuse element 2 alone, the bolts 30 can be temporarily fixed irrespective of the directions of the bolts 30. Therefore, the manufacturing process becomes simple, the design flexibility of the fuse element 2 will not be restricted due to the setting direction of bolts, and the structure of the metal mold is not complicated.

Since the bolts 30 are fixed to the insulative resin part 20 with the holding force of the insulating resin which is filled around the bolts 30 while the bolts 30 are fixed to the fuse element 2 with the screwing (fastening) force, compared with the conventional examples, the fixing strength of the bolts 30 is improved.

Unlike the conventional examples, it is not necessary to provide the pin entrances in the fuse element 2.

Since the temporary bolt fixing part are the threaded bolt holes 10 which are provided in the first terminal connecting part 4 and the second terminal connecting parts 5 and the bolts 30 can be temporarily fixed only by being screwed into the threaded bolt holes 10, it becomes easy to temporarily fix.

Second Embodiment

Figure 4:
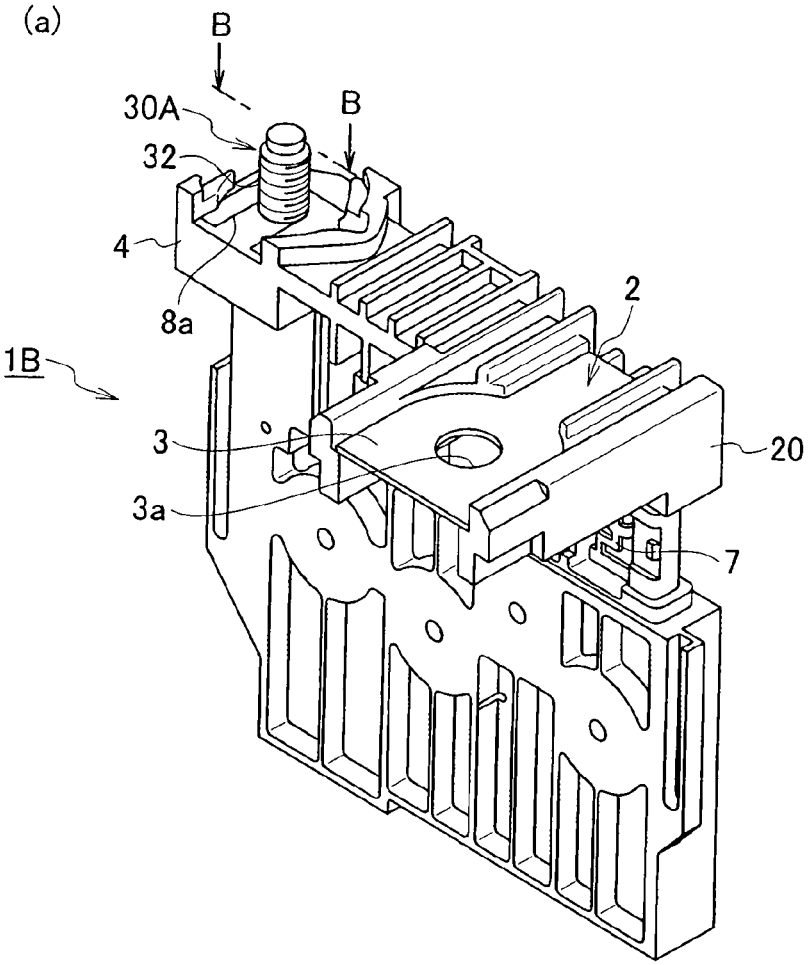
FIG. 4 shows a second embodiment of the invention, in which FIG. 4(*a*) is a perspective view of a fuse unit and FIG. 4(*b*) is a B-B line sectional view of FIG. 4(*a*).
Figure 4:
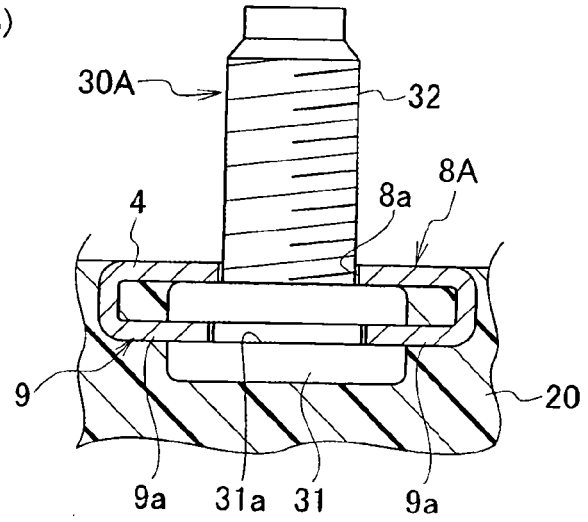
Figure 5:
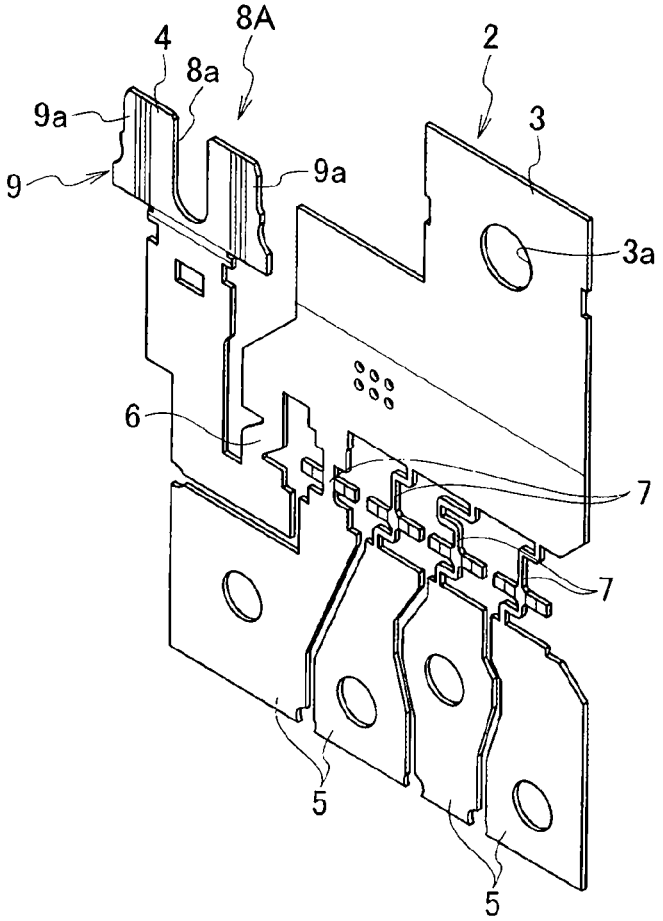
FIG. 5 shows the second embodiment of the invention and is a perspective view of a fuse element before the fuse element is bent.
Figure 6:
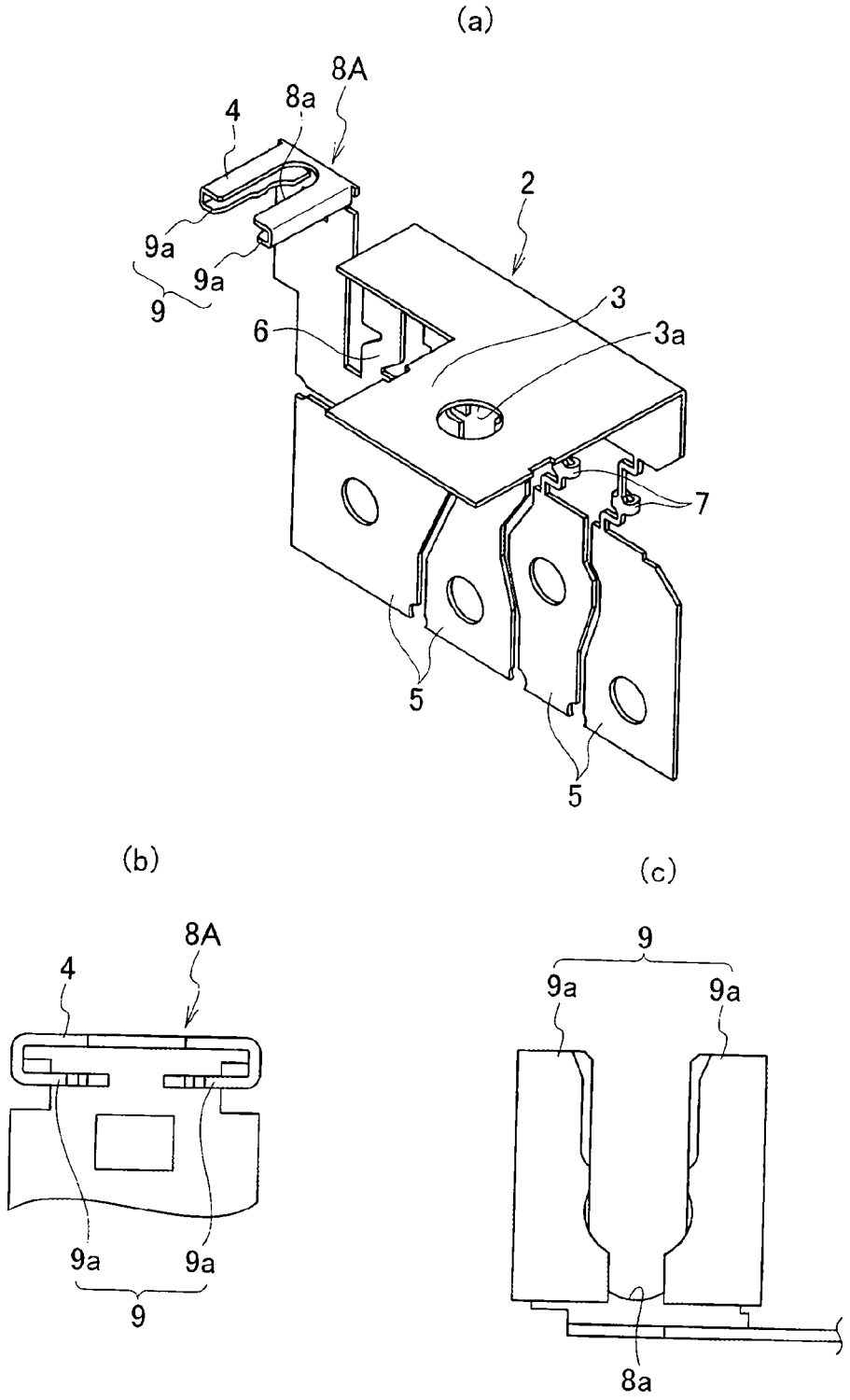
FIG. 6 shows the second embodiment of the invention, in which FIG. 6(*a*) is a perspective view of the fuse element, FIG. 6(*b*) is a front view of a first terminal connecting part of the fuse element and FIG. 6(*c*) is a bottom view of the first terminal connecting part of the fuse element.
Figure 7:
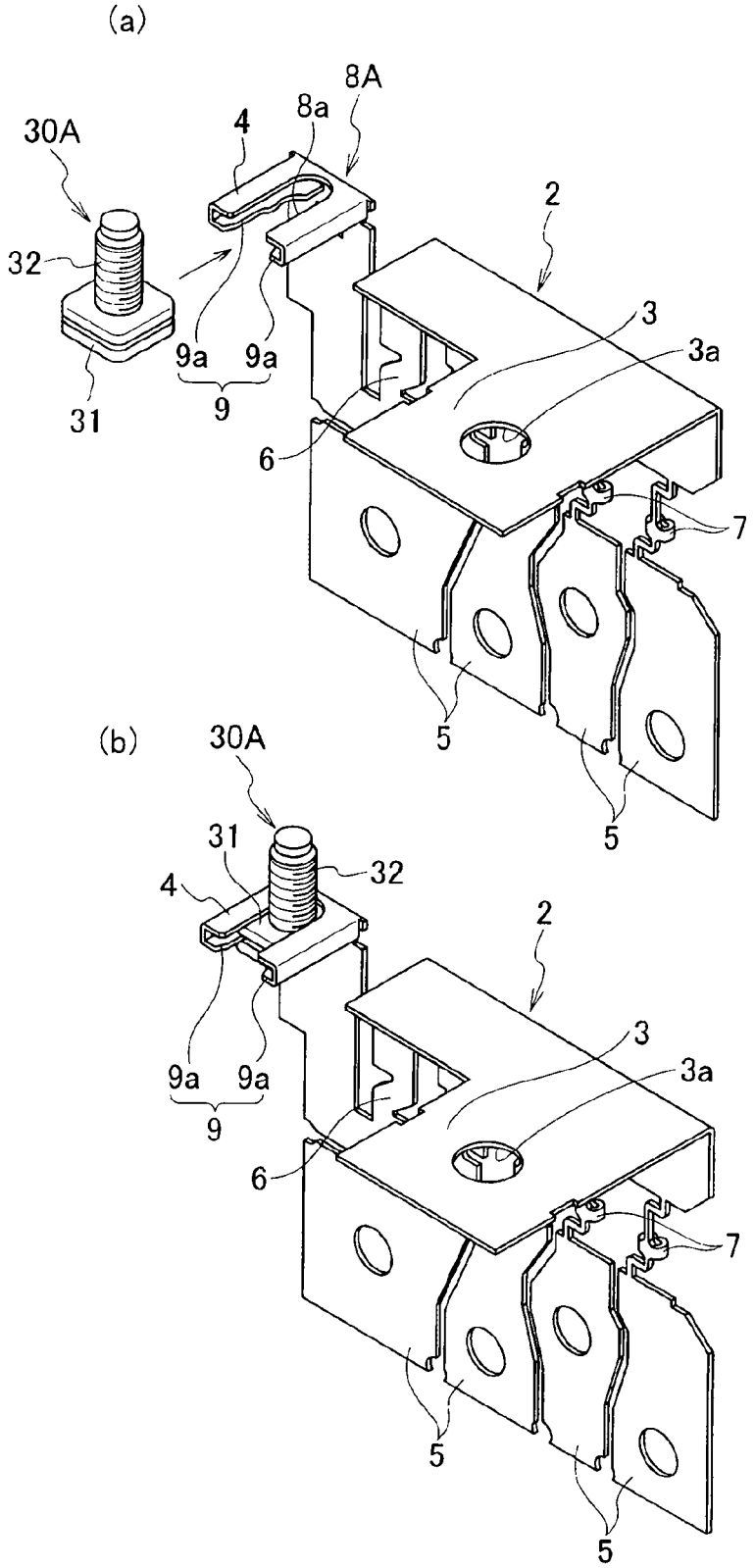
FIG. 7 shows the second embodiment of the invention, in which FIG. 7(*a*) is a perspective view which shows a process of temporarily fixing a bolt to the first terminal connecting part of the fuse element and FIG. 7(*b*) is a perspective view which shows a state that the bolt is temporarily fixed to the first terminal connecting part of the fuse element.
Figure 8:
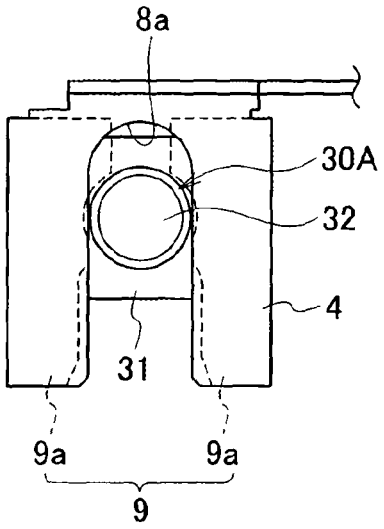
FIG. 8 shows the second embodiment of the invention, in which FIG. 8(*a*) is a top view of the first terminal connecting part to which the bolt is temporarily fixed, and FIG. 8(*b*) is a bottom view of the first terminal connecting part to which the bolt is temporarily fixed.
Figure 8:
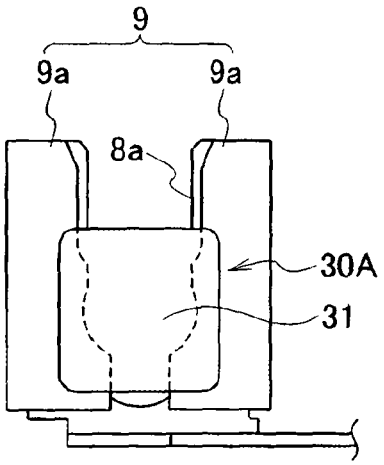
Figure 9:
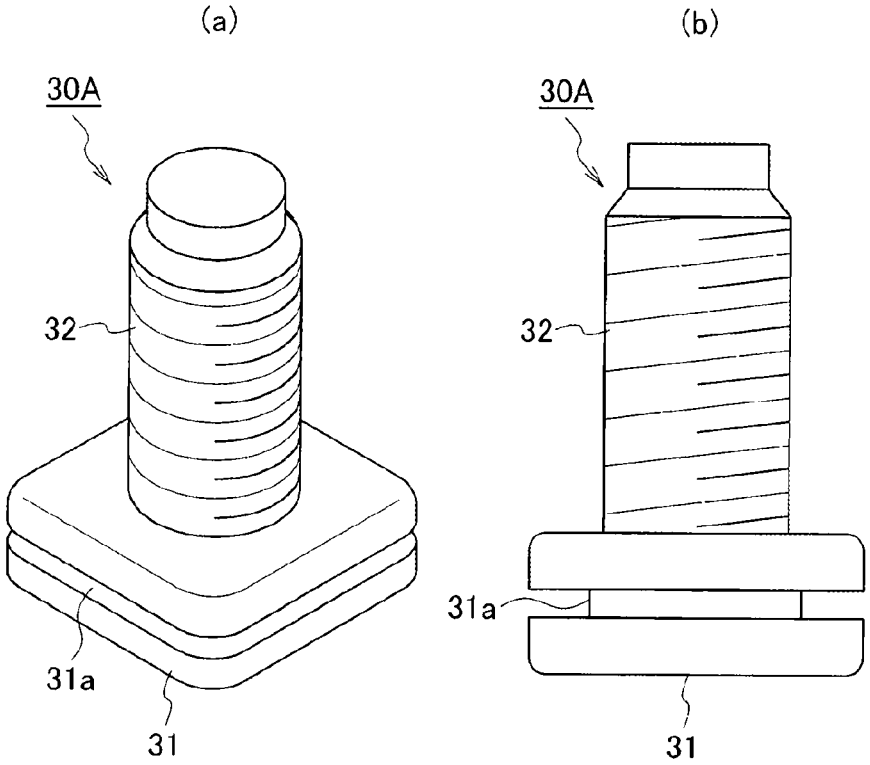
FIG. 9 shows the second embodiment of the invention, in which FIG. 9(*a*) is a perspective view of the bolt and FIG. 9(*b*) is a front view of the bolt.

FIGS. 4(*a*) to 9(*b*) shows the second embodiment of the invention, in which FIG. 4(*a*) is a perspective view of a fuse unit 1B and FIG. 4(*b*) is a B-B line sectional view of FIG. 4(*a*), FIG. 5 is a perspective view of a fuse element 2 before the fuse element 2 is bent, FIG. 6(*a*) is a perspective view of the fuse element 2, FIG. 6(*b*) is a front view of a first terminal connecting part 4 of the fuse element 2, FIG. 6(*c*) is a bottom view of the first terminal connecting part 4 of the fuse element 2, FIG. 7(*a*) is a perspective view which shows a process of temporarily fixing a bolt 30A to the first terminal connecting part 4 of the fuse element 2, FIG. 7(*b*) is a perspective view which shows a state that the bolt 30A is temporarily fixed to the first terminal connecting part 4 of the fuse element 2, FIG. 8(*a*) is a top view of the first terminal connecting part 4 to which the bolt 30A is temporarily fixed, FIG. 8(*b*) is a bottom view of the first terminal connecting part 4 to which the bolt 30A is temporarily fixed, FIG. 9(*a*) is a perspective view of the bolt 30A, and FIG. 9(*b*) is a front view of the bolt 30A.

As shown in FIGS. 4(*a*) and 4(*b*), the fuse unit 1B includes a fuse element 2 which is formed of a conductive metal plate (busbar), and an insulative resin part 20 which is arranged on the outer surface of the fuse element 2.

The fuse element 2, as shown in FIG. 6(*a*) in detail, includes a power supply connecting part 3 which is fixed to a battery post (not shown in the figures) via a battery connecting terminal (not shown in the figures), a first terminal connecting part 4 which has a bolt 30A, four second terminal connecting parts 5, a first fusible part 6 which is arranged between the power supply connecting part 3 and the first fusible part 6, and four fusible parts 7 which are respectively arranged between the power supply connecting part 3 and the second terminal connecting part parts 5.

A bolt insertion through hole 3*a* is formed in the power supply connecting part 3. The battery connecting terminal (not shown in the figures) is fixed by using the bolt insertion through hole 3*a*.

As shown in FIGS. 6(*a*) to 6(*c*) in detail, a temporary bolt fixing part 8A is formed at the first terminal connecting part 4. The temporary bolt fixing part 8A includes a bolt hole 8*a* which is provided in the first terminal connecting part 4 and which has an opening at the end of the fuse element 2, and a bolt holding part 9 which holds the bolt 30A which is slid and inserted into the bolt hole 8*a*. The bolt hole 8*a* is a U-shaped slot when viewed from top. The bolt holding part 9 is formed by bending a pair of clamping pieces 9*a*, which is stretched from two side ends of the first terminal connecting part 4, so that the pair of clamping pieces 9*a* face each other. Between the end surfaces, which are opposed to each other, of the pair of clamping pieces 9*a*, a narrow part is formed at a middle position between the entrance and the innermost position. The width between the end surfaces at the innermost position is set to be the same as the inner surface width of an annular groove 31*a* of the head 31 of the bolt 30A, and the width between the end surfaces at the narrow part is set to be slightly narrower than the inner surface width of the annular groove 31*a* of the head 31 of the bolt 30A.

As shown in FIGS. 7(*a*) and 7(*b*), the bolt 30A is slid and inserted into the bolt hole 8*a* and the pair of clamping pieces 9*a* of the first terminal connecting part 4. As shown in FIGS. 8(*a*) and 8(*b*) in detail, when the bolt 30A is slid and inserted, the rod 32 of the bolt 30A is inserted in the bolt hole 8*a*, and the pair of clamping pieces 9*a* enter the annular groove 31*a* of the head 31 of the bolt 30A. That is, when the pair of clamping pieces 9*a* are engaged with the annular groove 31*a* of the head 31 of the bolt 30A, the bolt 30A is temporarily fixed.

The bolt 30A includes the head 31 and the rod 32 on which an outer circumferential screw groove is formed, as shown in FIGS. 9(*a*) and 9(*b*). The annular groove 31*a* is formed on the sides of the head 31.

The insulative resin part 20 is formed with insertion molding by using both the fuse element 2 and the bolt 30A, which is temporarily fixed to the fuse element 2, as inserted components. The insulative resin part 20 generally covers those parts other than the electric supply connecting part 3, the first terminal connecting part 4, the second terminal connecting parts 5, the first fusible part 6 and the second fusible parts 7. The insulative resin part 20 is arranged so that there is no gap around the head 31 of each of the bolts 30A, as shown in FIG. 4(*b*) in detail. The head 31 of the bolt 30A is fixed with the insulative resin part 20 so that the head 31 cannot rotate.

Terminals (not shown in the figures) which are inserted to the bolts 30A are fixed to the first terminal connecting part 4 by being fastened with nuts (not shown in the figures).

Next, a method of manufacturing the fuse unit 1B of the above-mentioned structure is explained briefly. First, as shown in FIG. 5, the fuse element 2 of a flat shape is manufactured by punching a conductive metal plate material. Next, as shown in FIG. 6(*a*), the fuse element 2 of a desired shape is manufactured by being bent. The pair of clamping pieces 9*a* are also bent when the fuse element 2 is bent.

Next, as shown in FIG. 7(*a*), the bolt 30A is slid and inserted into the bolt hole 8*a* of the first terminal connecting part 4 and between the pair of clamping pieces 9*a*. Thereby, as shown in FIGS. 7(*b*) and 8(*a*) to 8(*b*), the bolt 30A is temporarily fixed to the fuse element 2.

Next, by using the fuse element 2 to which the bolts 30A are temporarily fixed as an inserted component, the insulative resin part 20 is formed with insertion molding on the outer surface of the fuse element 2. Thus, the manufacture of the fuse unit 1B shown in FIGS. 4(*a*) and 4(*b*) is completed.

As described above, since the bolt hole 8*a* and the bolt holding part 9 which are the temporary bolt fixing part 8A are provided in the first terminal connecting part 4 of the fuse element 2 so that the bolt 30A can be temporarily fixed to the fuse element 2, the insulative resin part 20 can be formed with insertion molding by using both the fuse element 2 and the bolt 30A as inserted components. Therefore, it is not necessary to press fit the bolt after the insertion molding. Since the bolt 30A can be temporarily fixed with the fuse element 2 alone, the bolt 30A can be temporarily fixed irrespective of the direction of the bolt 30A. Therefore, the manufacturing process becomes simple, the design flexibility of the fuse element 2 will not be restricted due to the setting direction of the bolt 30A, and the structure of the metal mold is not complicated.

Since the bolt 30A is fixed to the insulative resin part 20 with the holding force of the insulating resin which is filled around the bolt 30A while the bolt 30A is fixed to the fuse element 2 with the holding force of the bolt holding part 9, compared with the conventional examples, the fixing strength of the bolt 30A is improved.

Since the temporary bolt fixing part 8A includes the bolt hole 8*a* which is provided in the first terminal connecting part 4 and which has an opening at the end of the fuse element 2, and a bolt holding part 9 which holds the head 31 of the bolt 30A which is slid and inserted into the bolt hole 8*a* so that the bolt 30A can be temporarily fixed only by being slid and inserted into the bolt hole 8*a* and between the pair of clamping pieces 9*a*, it becomes easy to temporarily fix.

Since the pair of clamping pieces 9*a* which are stretched from the fuse element 2 are formed by being bent so that the bolt holding part 9 can be formed by bending the fuse element 2, the bolt holding part 9 can be manufactured easily without additional manufacturing processes or components.

Although the temporary bolt fixing part 8A is provided in the first terminal connecting part 4 in the second embodiment, it is also possible to provide the temporary bolt fixing part 8A similarly in each of the second terminal connecting parts 5.

Third Embodiment

Figure 10:
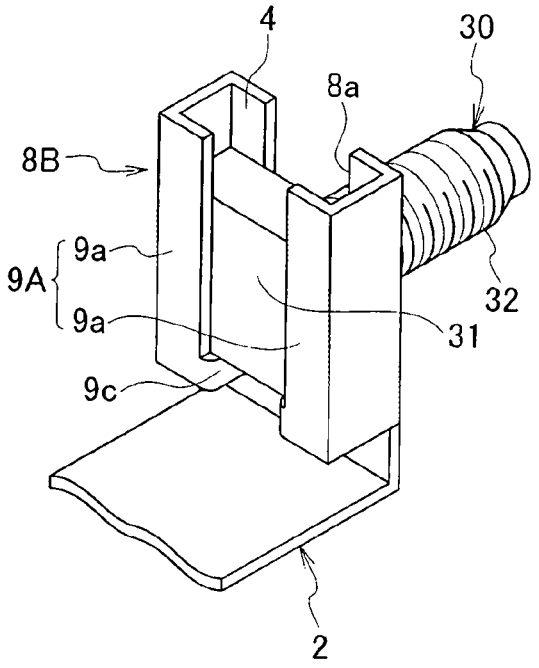
FIG. 10 shows a third embodiment of the invention and is a perspective view of the main parts of a first terminal connecting part of a fuse element.
Figure 11:
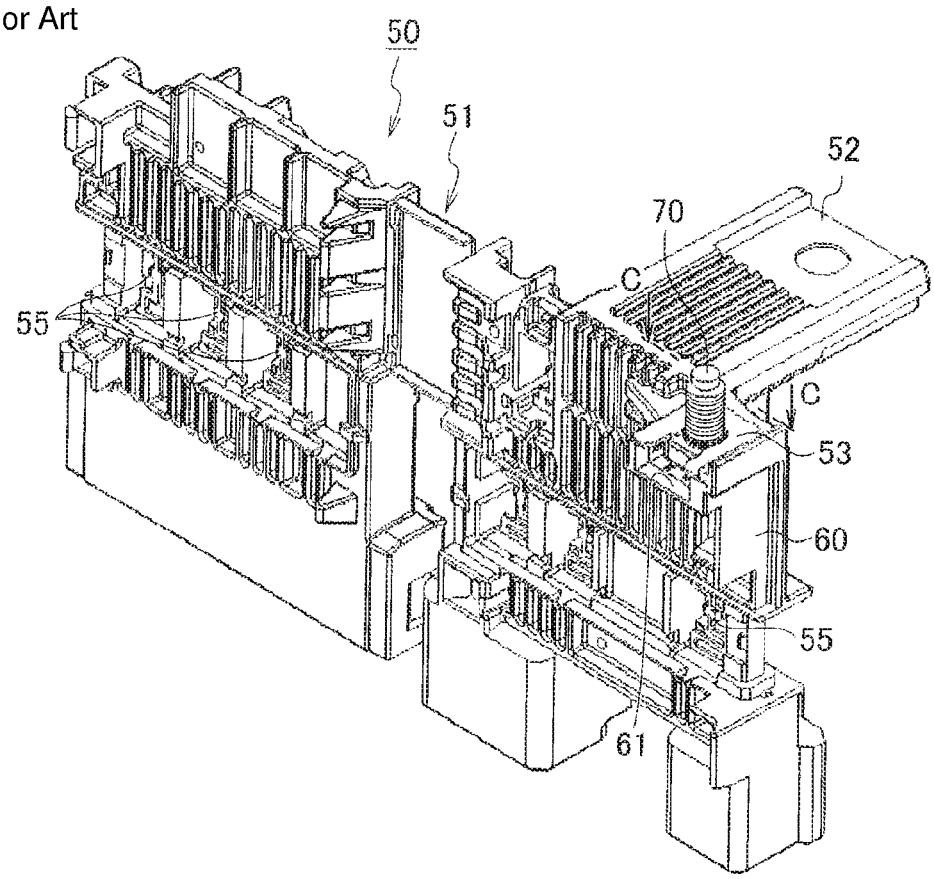
Fig. 11 Prior Art
FIG. 11 shows a first conventional example and is a perspective view of a fuse unit.
Figure 12:
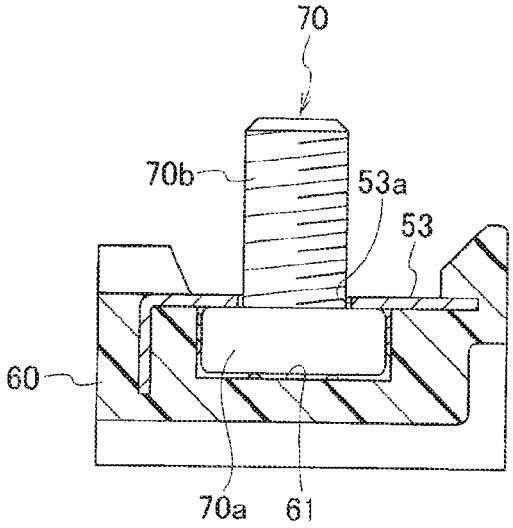
Fig. 12 Prior Art
FIG. 12 shows the first conventional example and is a C-C line sectional view of FIG. 11.
Figure 13:
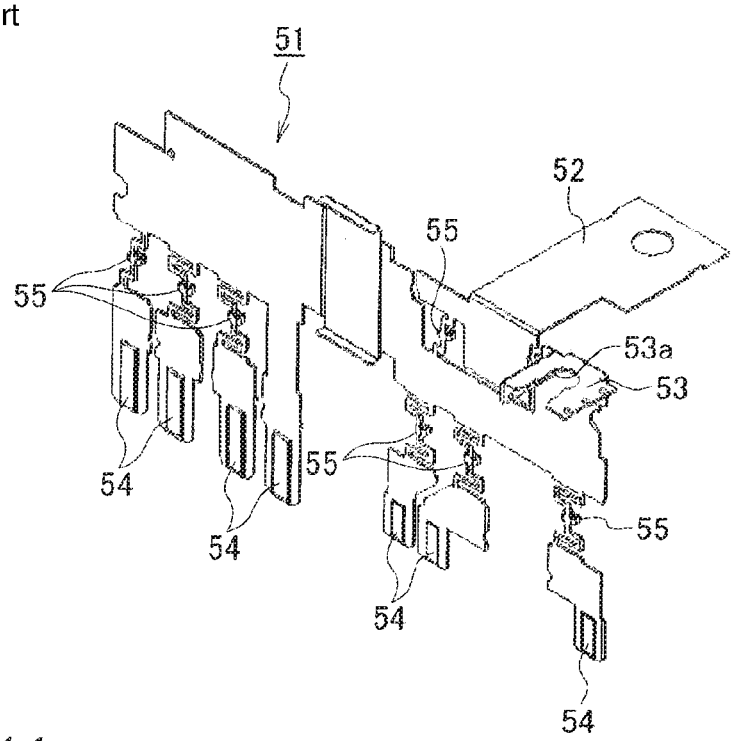
Fig. 13 Prior Art
FIG. 13 shows the first conventional example and is a perspective view of a fuse element.
Figure 14:
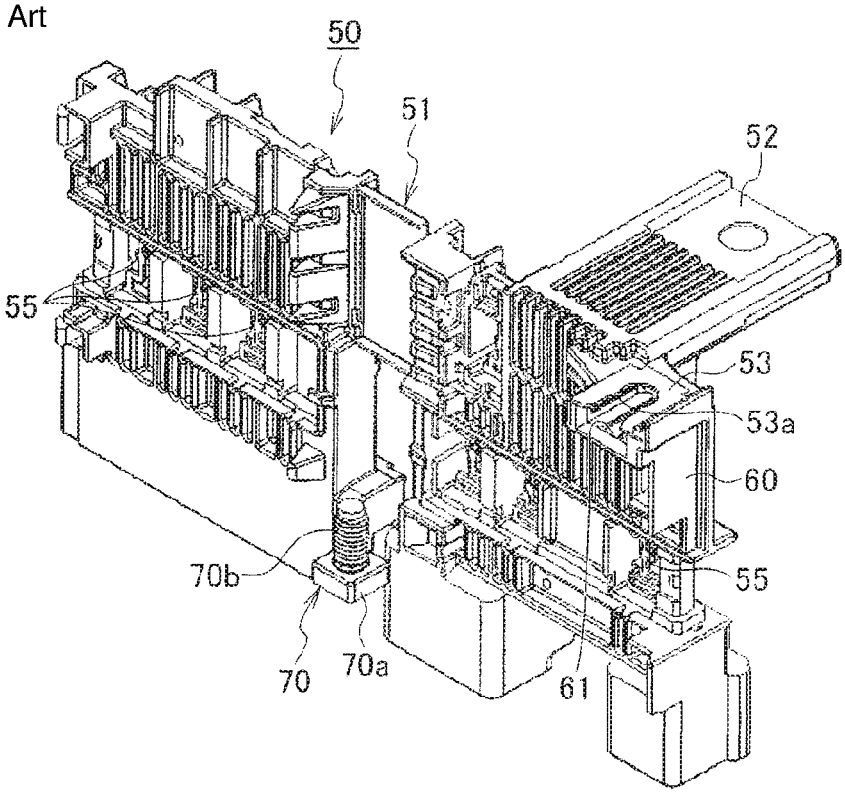
Fig. 14 Prior Art
FIG. 14 shows the first conventional example and is a perspective view which shows a process of press fitting a bolt.
Figure 15:
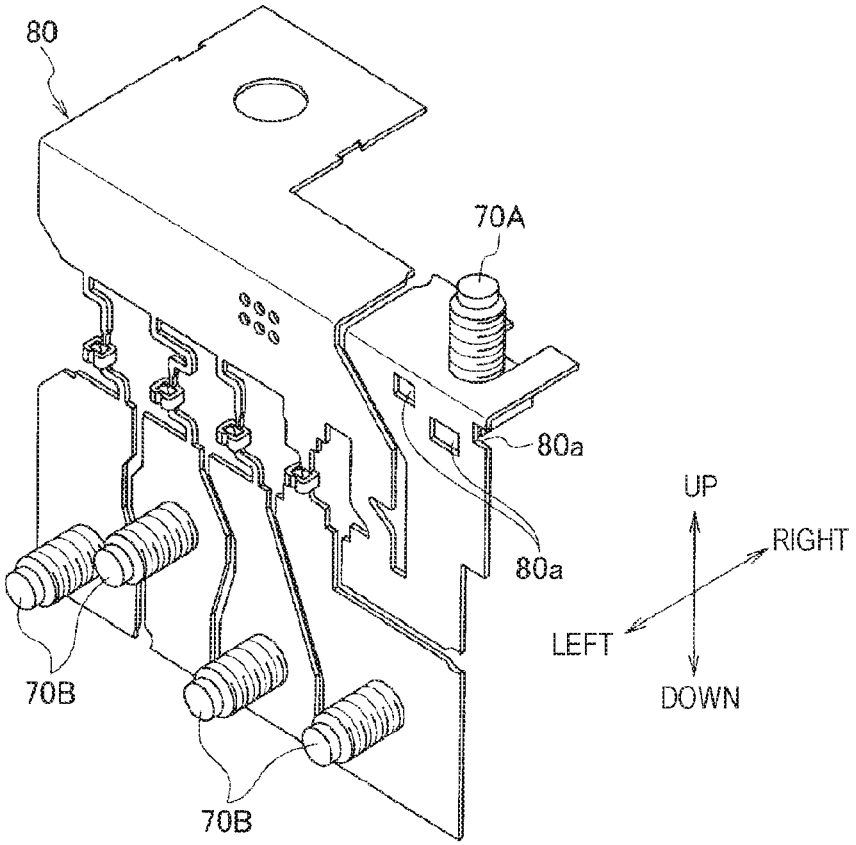
Fig. 15 Prior Art
FIG. 15 shows a second conventional example and is a perspective view of a fuse element and bolts which are temporarily fixed to the fuse element.

FIG. 10 is a perspective view of the main parts of a first terminal connecting part 4 of a fuse element 2 which is related to the third embodiment of the invention.

In the third embodiment, as shown in FIG. 10, a temporary bolt fixing part 8B is provided in the first terminal connecting part 4 of the fuse element 2 similarly to the second embodiment. Although the temporary bolt fixing part 8B also includes a bolt hole 8*a* which is provided in the first terminal connecting part 4 and which has an opening at the end of the fuse element 2, and a bolt holding part 9A which holds the bolt 30 which is slid and inserted into the bolt hole 8*a*, the structure of the bolt holding part 9A is different from that of the second embodiment.

The bolt holding part 9A is formed by bending a pair of press fitting pieces 9*b*, which is stretched from two side ends of the first terminal connecting part 4, at positions of a predetermined width so that the pair of press fitting pieces 9*b* face each other. The width between the pair of press fitting pieces 9*b* of the first terminal connecting part 4 is set to be only slightly larger than the height of the head 31 of the bolt 30.

Stoppers 9*c* which prevent the bolt 30 from excessively entering are provided at the press fitting pieces 9*b*, respectively.

As shown in FIGS. 7(*a*) and 7(*b*), the bolt 30 is slid and inserted into the bolt hole 8*a* and the inside space of the pair of press fitting pieces 9*b* of the first terminal connecting part 4. When the bolt 30 is slid and inserted, the rod 32 of the bolt 30A is inserted into the bolt hole 8*a*, and the head 31 of the bolt 30A is press fitted into the pair of press fitting pieces 9*b*. That is, the bolt 30 is temporarily fixed to the fuse element 2 by being press fitted.

The bolt 30 includes the head 31 and the rod 32 on the outer surface of which a screw groove is formed.

Since the other structures are the same as those of the above embodiment, the explanations are omitted.

In the third embodiment, a fuse unit (not shown in the figure) can also be manufactured with the same manufacturing procedures as the above-mentioned second embodiment.

As described above, since the bolt hole 8*a* and the bolt holding part 9A which are the temporary bolt fixing part 8B are provided in the first terminal connecting part 4 of the fuse element 2 so that the bolt 30 can be temporarily fixed to the fuse element 2, the insulative resin part (not shown in the figure) can be formed with insertion molding by using both the fuse element 2 and the bolt 30 as inserted components. Therefore, it is not necessary to press fit the bolt after the insertion molding. Since the bolt 30 can be temporarily fixed with the fuse element 2 alone, the bolt 30 can be temporarily fixed irrespective of the direction of the bolt 30. Therefore, the manufacturing process becomes simple, the design flexibility of the fuse element 2 will not be restricted due to the setting direction of the bolt 30, and the structure of the metal mold is not complicated.

Since the bolt 30 is fixed to the insulative resin part (not shown in the figure) with the holding force of the insulating resin which is filled around the bolt 30 while the bolt 30 is fixed to the fuse element 2 with the holding force of the bolt holding part 9A, compared with the conventional examples, the fixing strength of the bolt 30 is improved.

Since the temporary bolt fixing part 8B includes the bolt hole 8*a* which is provided in the first terminal connecting part 4 and which has an opening at the end of the fuse element 2, and a bolt holding part 9A which holds the head 31 of the bolt 30 which is slid and inserted into the bolt hole 8*a* so that the bolt 30 can be temporarily fixed only by being slid and inserted into the bolt hole 8*a* and the pair of press fitting pieces 9*b*, it becomes easy to temporarily fix.

Since the pair of press fitting pieces 9*b* which are stretched from the fuse element 2 are formed by being bent, the bolt holding part 9A can be manufactured easily without additional manufacturing processes or components.

Although the temporary bolt fixing part 8B is provided in the first terminal connecting part 4 in the third embodiment, it is also possible to provide the temporary bolt fixing part 8B similarly in each of the second terminal connecting parts 5.

Although the present invention is described in detail with reference to the embodiments, it is apparent that various modifications and amendments may be made by those skilled in the art without departing from the spirit and scope of the invention.

REFERENCE SIGNS LIST

1A,1B FUSE UNIT
2 FUSE ELEMENT
4 FIRST TERMINAL CONNECTING PART (TERMINAL CONNECTING PART)
5 SECOND TERMINAL CONNECTING PART (TERMINAL CONNECTING PART)
8, 8A TEMPORARY BOLT FIXING PART
8*a* BOLT HOLE
9, 9A BOLT HOLDING PART
10 THREADED BOLT HOLE (TEMPORARY BOLT FIXING PART)
20 INSULATIVE RESIN PART
30, 30A BOLT
31 HEAD

The invention claimed is:

1. A fuse unit comprising:

a fuse element;

a terminal connecting part formed as one-piece with the fuse element; and an insulative resin part which is arranged on an outer surface of the fuse element, wherein a temporary bolt fixing part, which temporarily fixes a bolt to the terminal connecting part, is provided in the fuse element, wherein the temporary bolt fixing part is a threaded bolt hole which is provided in the terminal connecting part, wherein the threaded bolt hole is threaded to temporarily fix the bolt when the bolt is screwed into the threaded bolt hole, and wherein the insulative resin part is inserted-molded with the fuse element and the bolt screwed into the threaded bolt hole being inserted components such that a head of the bolt is embedded in the insulative resin part.

2. The fuse unit according to claim 1, wherein the temporary bolt fixing part temporarily fixes the bolt to the terminal connecting part before an injection molding of the insulative resin part.

* * * * *